US005632385A

United States Patent [19]

Mantey

[11] Patent Number: 5,632,385

[45] Date of Patent: May 27, 1997

[54] REMOTE CONTROL WAND

[76] Inventor: Keith M. Mantey, 5826 Sandshell Ct., Dallas, Tex. 75252

[21] Appl. No.: 390,137

[22] Filed: Feb. 17, 1995

[51] Int. Cl.[6] ..... A47F 7/00

[52] U.S. Cl. ..... 211/26.1

[58] Field of Search ..... 211/13, 26, 86, 211/126; 248/205.2, 172, 176

[56] References Cited

U.S. PATENT DOCUMENTS 4,911,389 3/1990 Self .
4,991,817 2/1991 Von Kleist et al. .
5,125,516 6/1992 McKenna .
5,244,173 9/1993 Kulyk ..... 248/176
5,337,904 8/1994 Goldberg ..... 211/13
5,370,238 12/1994 Czajkowski et al. ..... 211/13

*Primary Examiner*—Ramon O. Ramirez
*Assistant Examiner*—Sarah L. Purol
*Attorney, Agent, or Firm*—Baker & Botts, L.L.P.

[57] ABSTRACT

A remote control wand (10) having an inclined top surface (36) and an ergonomic shape to fit a user's hand is provided. The remote control units (50) may be detachably coupled to the top surface (36) of the wand (10). The remote control units (50) may be positioned side-by-side near either or both ends of the wand (10).

15 Claims, 1 Drawing Sheet

REMOTE CONTROL WAND

TECHNICAL FIELD OF THE INVENTION

This invention is related in general to a holder for holding remote control units for electronic entertainment equipment. More particularly, the invention is related to a remote control wand.

BACKGROUND OF THE INVENTION

Presently, most or all of our electronic entertainment equipment can be remotely controlled with remote control units. Television sets, video cassette recorders, laser disc players, compact disc players, audio tape players, stereo receivers are each equipped with remote control units that provide the convenience of operating the various equipment from the comfort of a couch. In a well equipped home entertainment center, the number of remote control units needed to control all the devices is numerous. Although there has been an introduction of universal remote control units, many users do not like the expense of a separate control unit and/or the complexity of programming the universal remote. The universal remote control units now available are also not capable of handling all types and/or brands of electronic equipment.

When there is a large number of remote control units, it becomes difficult to keep them organized and easily accessible. Most often, the remote control units are hidden under stacks of newspapers, books, and mail or simply become lost.

SUMMARY OF THE INVENTION

Accordingly, there is a need for a remote control unit holder that keeps the remote control units organized, visible and easily accessible.

In accordance with the present invention, a remote control wand is provided which eliminates or substantially reduces the disadvantages associated with prior remote control holders, racks or caddies.

In one aspect of the invention, a remote control wand with a top surface and an easy-grip shape is provided. The remote control units are detachably coupled to the top surface either near one end of the wand leaving room for the user to grip at the other end, or be attached near both ends of the wand and leaving room in the center.

In another aspect of the invention, a method for organizing remote control units is provided. The method includes the steps of providing an ergonomically shaped wand with an inclined top surface. The remote control units are then detachably coupled to the top surface.

BRIEF DESCRIPTION OF THE DRAWINGS

For a better understanding of the present invention, reference may be made to the accompanying drawings, in which.

DETAILED DESCRIPTION OF THE INVENTION

Figure 1:
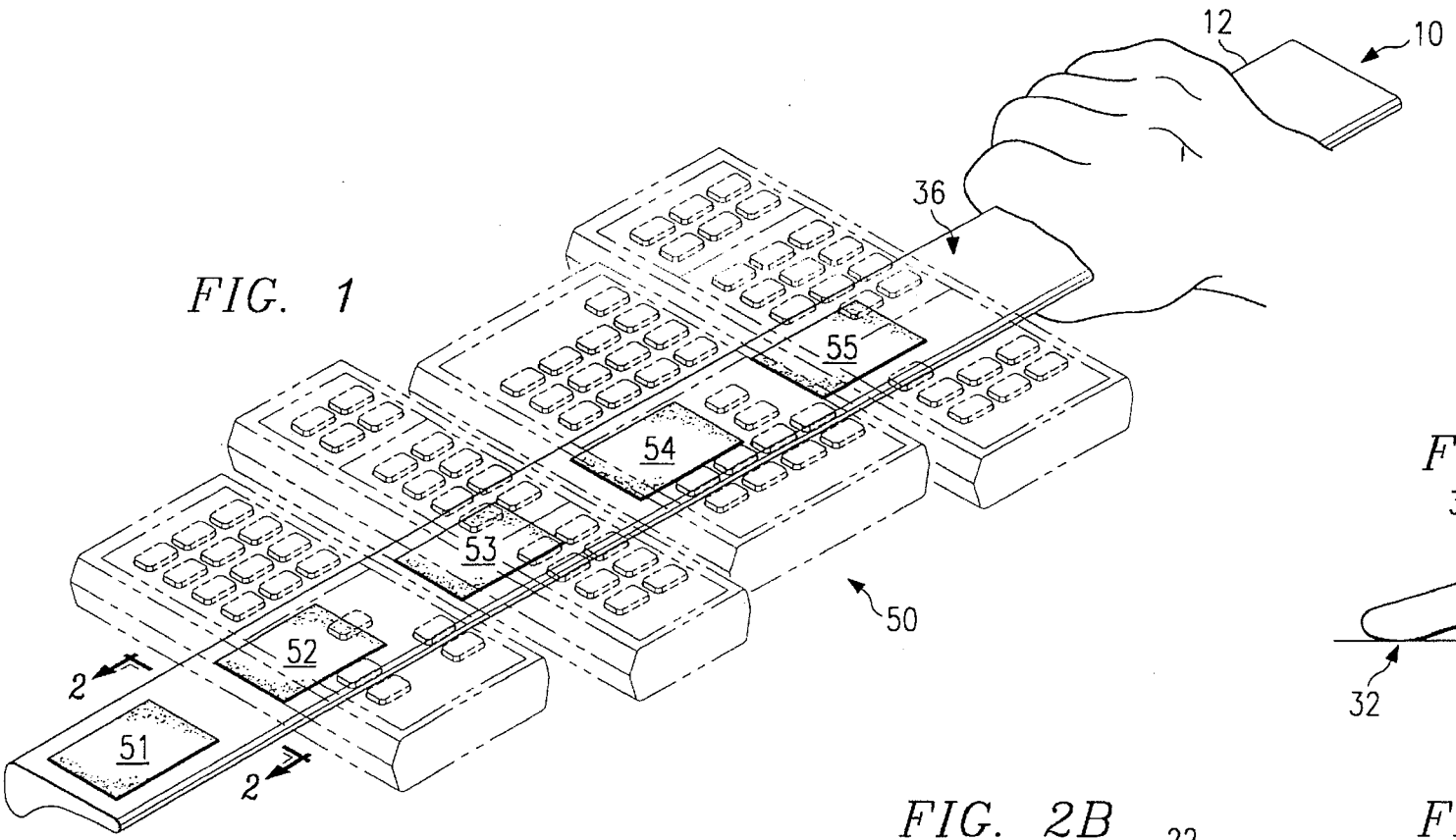
FIG. 1 is a perspective view of the remote control wand constructed in accordance with the teachings of the present invention.

Referring to FIG. 1, an embodiment the remote control wand 10 constructed according to the present invention is shown. The remote control wand 10 is preferably constructed from a single piece of natural material, such as wood, or synthetic material such as plastic. The plastic construction may be thermoplastic which is injection molded, or molded and formed by another means.

Figure 2A:
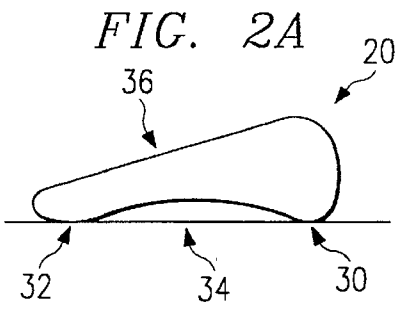
FIGS. 2*a*–2*c* are cross-sectional views of embodiments of the remote control wand.
Figure 2C:
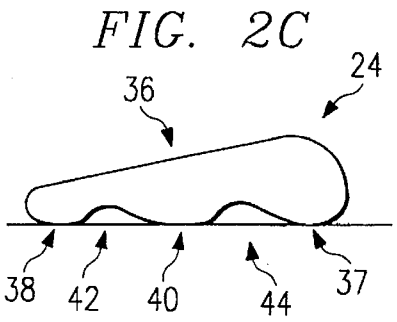
Figure 2B:
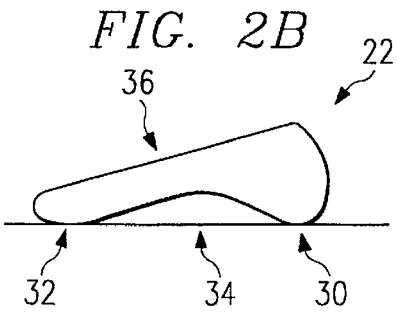

The remote control wand 10 is a long piece of material 12 formed or shaped to the desire ergonomic cross-sectional shape to facilitate gripping and handling. For example, as shown in FIGS. 2*a*–2*c*, the substantially kidney-shaped cross-sectional shapes 20–24 of the wand 10 are equally applicable. In FIGS. 2*a* and 2*b*, the cross-sectional areas have an enlarged portion 30, a thinner portion 32, and a transitional narrower portion 34 with slightly different degrees of curvature. When gripped by the user's hand, the thicker portion 30 fits in the bend formed under the user's knuckles, the transitional narrower portion 34 fits under the user's fingertips, and the thinner portion 32 fits between the user's palm and the thumb, as shown. A sure and comfortable grip is thus achieved. The wand 10 further includes a substantially flat surface 36, which lies on an angular incline when the wand 10 is resting on a flat surface such as the coffee table top. In FIG. 2*c*, another exemplary cross-sectional area 24 includes three enlarged portions 37–40, and two narrow sections 42 and 44. The cross-sectional area of the wand 10 may be viewed as having a finger grip section 30, 34, 37, 40–44 and a thumb grip section 32, 38, and 42. Similarly, the wand cross-section may be shaped or formed into other ergonomic shapes not shown herein, where the primary objective is ease of grip and handling, and still be within the contemplation of the present invention. In general, the wand 10 should have rounded corners without sharp angles. The degree of incline may also be modified by changing the shape of the cross-sectional areas such as increasing the enlarged portions 30 and 37.

Depending on whether the user is right- or left-handed, the location of the remote control units on the wand 10 may be determined accordingly. For example, as shown in FIG. 1, the user is right-handed, and therefore remote control units 50 (shown in phantom) are located on the left hand side of the wand 10 leaving room on the right hand side of the wand 10 for the user's hand to grip the wand 10. It may even be preferable to locate the remote control units 50 near both ends of the wand 10 with gripping room in the center of the wand 10. The remote control units 50 are adhered or attached side-by-side to the inclined top surface 36 by flat fasteners 51–55 such as Velcro, or other fastening elements of various shapes, such as mushrooms-like, umbrella-like, arrowhead-like structures.

Unlike certain other remote control caddies or racks, the remote control wand 10 is easy to assemble and use. The user first determines the approximate locations each remote control unit will occupy on the wand 10. The user simply cut the supplied self-adhesive velcro hook and loop strips into appropriate sizes and attach the Velcro hook pads 51–55 to the back of each remote control units 50. The user then attach the Velcro loop pads 51–55 to the inclined surface 36 of the wand 10 at appropriate locations. The remote control units 50 are therefore detachably secured to the inclined surface of the wand 10, which displays the units 50 at an angle toward the user. The location of the remote control units 50 may be changed simply by rearranging the remote control units 50, or by reattaching the Velcro pads to the new locations. New remote control units can be easily added to the wand 50 by simply attaching it to a free spot on the wand 10.

To use any of the remote control units 50, the user may pick up the wand 10 along with all the remote control units 50 and enter his or her selection on any or all of the control units. The user may also leave the wand 10 on any surface, such as a coffee table top, and enter the selection without picking up the wand 10.

Constructed and assembled in this manner, all the remote control units 50 are centrally located in one spot, so that they are easily located or spotted and are not subject to disappearing behind the sofa or under the mail. Further, the remote control wand 10 is simple in construction, not bulky or cumbersome and therefore does not add clutter to the user's living quarters.

Although the present invention and its advantages have been described in detail, it should be understood that various changes, substitutions and alterations can be made therein without departing from the spirit and scope of the invention as defined by the appended claims.

What is claimed is:

1. A remote control wand for holding a plurality of remote control units, comprising:

a long and narrow member having a substantially flat top surface, said long and narrow member having a remote portion and a handle portion, said handle portion having a cross-sectional circumference grippable by a human hand and a substantially kidney-shaped cross-sectional area for facilitating gripping by the human hand; and fasteners coupled to said top surface of said remote portion of said long and narrow member for attaching to each of said plurality of remote control units.

2. The remote control wand, as set forth in claim 1, wherein said substantially flat top surface of said remote portion of said long and narrow member is inclined at an angle.

3. The remote control wand, as set forth in claim 1, wherein said substantially kidney-shaped cross-sectional area of said handle portion includes a predetermined curvilinear shape for facilitating gripping and handling including a finger grip portion and a thumb grip portion.

4. The remote control wand, as set forth in claim 1, wherein said long and narrow member is constructed of wood.

5. The remote control wand, as set forth in claim 1, wherein said long and narrow member is constructed of a synthetic material.

6. The remote control wand, as set forth in claim 1, wherein said fasteners includes complementary engaging portions, one of said portions being secured to said top surface of said long and narrow member, the other of said portions being secured to each of said plurality of remote control units.

7. A remote control holder, comprising:

a wand having a substantially flat and angled top surface and a substantially kidney-shaped cross-sectional area; and a plurality of fasteners detachably coupling a plurality of remote control units to said substantially flat and angled top surface at selected locations excluding a handle portion of said wand.

8. The remote control holder, as set forth in claim 7, wherein said substantially kidney-shaped cross-sectional area of said handle portion includes:

a first curvilinear portion formed along a top edge of said wand;

a second curvilinear portion formed along a bottom edge of said wand; and said first and second curvilinear portions facilitating gripping by a human hand.

9. The remote control holder, as set forth in claim 7, wherein said substantially kidney-shaped cross-sectional area of a handle portion includes:

a first curvilinear portion formed along a top edge of said wand;

a second curvilinear portion formed along a bottom edge of said wand;

a transitional portion formed between said first and second curvilinear portions; and said first and second curvilinear portions and transitional portions facilitating gripping by a human hand.

10. The remote control holder, as set forth in claim 7, wherein said plurality of fasteners include hook and loop pads having self-adhesive surfaces.

11. A method for organizing remote control units, comprising the steps of:

providing a bar having a substantially flat top surface and a substantially kidney-shaped cross-sectional area; and detachably adhering said remote control units to selected locations on said substantially flat top surface of said bar.

12. The method, as set forth in claim 11, further comprising the step of forming said bar into an easy grip shape.

13. The method, as set forth in claim 11, further comprising the step of attaching pads having a plurality of hooks to backs of said remote control units and pads having a plurality of loops to selected respective spots on said flat top bar surface.

14. The method, as set forth in claim 11, further comprising the step of attaching pads having a plurality of loops to backs of said remote control units and pads having a plurality of kooks to selected respective spots on said flat top bar surface.

15. The method, as set forth in claim 11, wherein the step of providing the bar comprises the steps of:

forming a first cross-sectional area portion of said bar into a curvilinear portion for facilitating gripping by human fingers; and forming a second cross-sectional area portion of said bar into a curvilinear portion for facilitating gripping by a human thumb.

* * * * *